US007320441B2

(12) United States Patent
Boehland

(10) Patent No.: US 7,320,441 B2
(45) Date of Patent: Jan. 22, 2008

(54) INJECTION NOZZLE

(75) Inventor: Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 213 days.

(21) Appl. No.: 10/549,577

(22) PCT Filed: Sep. 7, 2004

(86) PCT No.: PCT/DE2004/001978

§ 371 (c)(1),
(2), (4) Date: Sep. 19, 2005

(87) PCT Pub. No.: WO2005/052352

PCT Pub. Date: Jun. 9, 2005

(65) Prior Publication Data

US 2006/0180679 A1 Aug. 17, 2006

(30) Foreign Application Priority Data

Nov. 11, 2003 (DE) ..... 103 52 504

(51) Int. Cl.
*F02M 47/02* (2006.01)
*B05B 1/30* (2006.01)
*B05B 1/34* (2006.01)

(52) U.S. Cl. ..... 239/533.11; 239/88; 239/533.1; 239/533.12; 239/89; 239/92; 123/467; 123/299

(58) Field of Classification Search ..... 239/88–92, 239/124, 96, 533.2, 533.3, 533.12; 251/122, 251/333; 123/446–447, 467
See application file for complete search history.

(56) References Cited

U.S. PATENT DOCUMENTS 5,899,389 A 5/1999 Pataki et al.

6,378,503 B1 * 4/2002 Lambert ..... 123/468

(Continued)

FOREIGN PATENT DOCUMENTS

DE 38 24 467 A1 1/1990
WO WO 03/054375 A1 7/2003

*Primary Examiner*—Dinh Q. Nguyen
*Assistant Examiner*—James S. Hogan
(74) *Attorney, Agent, or Firm*—Ronald E. Greigg

(57) ABSTRACT

The present invention relates to an injection nozzle (1) for an internal combustion engine, in particular in a motor vehicle. A first nozzle needle (3) controls at least one first injection opening (5). A second nozzle needle (4) controls at least one second injection opening (6). A control chamber (32) is connected via a throttle line (35) to a pressure chamber (34) in which it is possible to adjust the injection pressure. A first control piston (41) cooperates with a first needle unit (17) that includes the first nozzle needle (3) and the first control surface (43) of this first control piston (41) can be acted on by the control pressure prevailing in the control chamber (32). In the closed position of the first nozzle needle (3), there is an axial play (44) between the first control piston (41) and the first needle unit (17). A second control piston (42) cooperates with a second needle unit (30) that includes the second nozzle needle (4) and can be acted on with the control pressure on a second control surface (45). In a closed position of the second nozzle needle (4), the second control piston (42) rests against the second nozzle needle (4) on the second needle unit (30). At middle to high pressures in the pressure chamber (34), both nozzle needles (3, 4) can close quickly. With a rapid pressure increase in the pressure chamber (34), the second nozzle needle (4) can open quickly and the two nozzle needles (3, 4) can close quickly. With a relatively low to middle speed pressure increase in the pressure chamber (34), the second nozzle needle (4) does not open or only opens at a higher pressure.

20 Claims, 2 Drawing Sheets

U.S. PATENT DOCUMENTS 6,484,698 B2 * 11/2002 Boecking ..... 123/467
6,557,529 B2 * 5/2003 Boecking ..... 123/467
6,705,543 B2 * 3/2004 Carroll et al. ..... 239/96
6,769,634 B2 * 8/2004 Brenk et al. ..... 239/533.3
6,793,159 B2 * 9/2004 Bloching et al. ..... 239/533.2
6,810,857 B2 * 11/2004 Boehland et al. ..... 123/467
6,811,105 B2 * 11/2004 Kato et al. ..... 239/533.2
6,896,208 B2 * 5/2005 Kuegler ..... 239/533.4
2004/0065751 A1 4/2004 Boehland et al.

* cited by examiner

INJECTION NOZZLE

CROSS-REFERENCE TO RELATED APPLICATIONS

This application is a 35 USC 371 application of PCT/DE 2004/001978 filed on Sep. 7, 2004.

BACKGROUND OF THE INVENTION

1. Field of the Invention

The present invention relates to an improved fuel injection nozzle for an internal combustion engine, in particular in a motor vehicle.

2. Description of the Prior Art

An injection nozzle of the type with which this invention is concerned is known, for example, from DE 100 58 153 A1 and has a first nozzle needle embodied in the form of a hollow needle and a second nozzle needle situated coaxial to the first nozzle needle. The first nozzle needle can control an injection of fuel through at least one first injection opening while the second nozzle needle can control the injection of fuel through at least one second injection opening. A control piston is provided for actuating the second nozzle needle and axially cooperates with the second nozzle needle or a second needle unit that includes the second nozzle needle. A control surface of this control piston oriented away from the injection openings is situated in a control chamber and can be acted by the control pressure prevailing therein. In a closed position of the second nozzle needle, the control piston rests axially against the second nozzle needle or second needle unit.

The first nozzle needle in the known injection nozzle can be directly controlled with the injection pressure, i.e. the first nozzle needle opens as soon as a sufficiently high injection pressure acts on a corresponding pressure shoulder of the first nozzle needle. If a fuel injection is to be executed only by means of the at least one first injection opening, then the control chamber is subjected to a correspondingly high control pressure so that the second nozzle needle remains closed. If a fuel injection is to also be executed by means of the at least one second injection opening, then the pressure in the control chamber is reduced until the injection pressure acting on a corresponding pressure shoulder on the second nozzle needle causes the second nozzle needle to open. The second nozzle needle is consequently controlled not by means of the injection pressure, but by means of the control pressure prevailing in the control chamber, which is also referred to as servo control. It is relatively expensive to implement a servo control this kind.

SUMMARY AND ADVANTAGES OF THE INVENTION

The injection nozzle according to the present invention has the advantage over the prior art that both the first nozzle needle and the second nozzle needle are controlled directly as a function of the injection pressure. The injection nozzle according to the present invention thus eliminates the costs of implementing a servo control. Moreover, the injection nozzle according to present invention has comparatively high closing dynamics for both nozzle needles and also has high opening dynamics for the second nozzle needle at comparatively high injection pressures. As a result, the nozzle needles react very quickly to the closing so that extremely short closing times can be achieved. The second nozzle needle then also reacts to the opening with a corresponding rapidity so that relatively short opening times for the second nozzle needle can also be achieved.

Thanks to the proposed throttled coupling of the control chamber to the pressure chamber, a pressure compensation between the pressure chamber and the control chamber only occurs in a delayed fashion. In order to open the nozzle needles, the pressure in the pressure chamber, namely the injection pressure, is increased in order to act directly on a corresponding pressure shoulder of the first nozzle needle. With sufficient injection pressure, the first nozzle needle opens. When the first nozzle needle is opened, the injection pressure can also build up against a corresponding pressure shoulder of the second nozzle needle. Since the pressure in the control chamber rises significantly more slowly, the second nozzle needle is thus already able to open at low injection pressures, i.e. earlier. In the closing of the nozzle needles, the delayed pressure compensation between the control chamber and the pressure chamber results in a shortening of the closing times. In order to close the nozzle needles, the injection pressure in the pressure chamber is reduced. This reduces the pressure acting on the pressure shoulders of the nozzle needles in the opening direction. The pressure in the control chamber cannot fall as quickly, thus resulting in very powerful closing forces for the nozzle needles, which forces accelerate, i.e. shorten, the closing process of the two nozzle needles. The essential thing here is that an additional servo valve is not required for triggering the second nozzle needle to open and close.

According to an advantageous embodiment form, a first closing spring can be provided, which, on the one hand, drives the first nozzle needle or first needle unit in the closing direction and on the other hand, directly or indirectly drives the first control piston into an initial position in which there is an axial play between the first control piston and the first nozzle needle or first needle unit. Because of this design, there is an axial play between the first control piston and the first nozzle needle or first needle unit when the first nozzle needle is in its closed position. When the first nozzle needle opens, it can lift independently of the first control piston within the range of the axial play, as a result of which the first nozzle needle is decoupled from the forces acting on the first control piston in the control chamber.

According to a preferred modification, the first control piston can constitute a first stroke stop for the first nozzle needle or first needle unit in such a way that in an open position of the first nozzle needle, the first control piston comes into direct axial contact with this first nozzle needle or the first needle unit. For the closing process, this means that the first control piston can transmit the compressive force prevailing in the control chamber directly to the first nozzle needle or first needle unit, in particular without an idle stroke. On the one hand, this achieves a rapid reaction of the first nozzle needle and on the other hand, makes it possible to avoid generating noise.

In another advantageous modification, the first control piston can constitute a second stroke stop for the second nozzle needle or second needle unit in such a way that in an open position of the second nozzle needle, the first control piston comes into axial contact directly against this second nozzle needle or second needle unit. On the one hand, this embodiment form also lends the first control piston a double function and on the other hand, it assures a rapid reaction of the second nozzle needle during closing; here, too, it is possible to avoid an idle stroke and a consequent generation of noise.

Other important characteristics and advantages of the injection nozzle according to the present invention are disclosed.

BRIEF DESCRIPTION OF THE DRAWINGS

Exemplary embodiments of the injection nozzle according to the present invention are explained in detail herein below, with reference to the drawings, in which.

DESCRIPTION OF THE PREFERRED EMBODIMENTS

Figure 1:
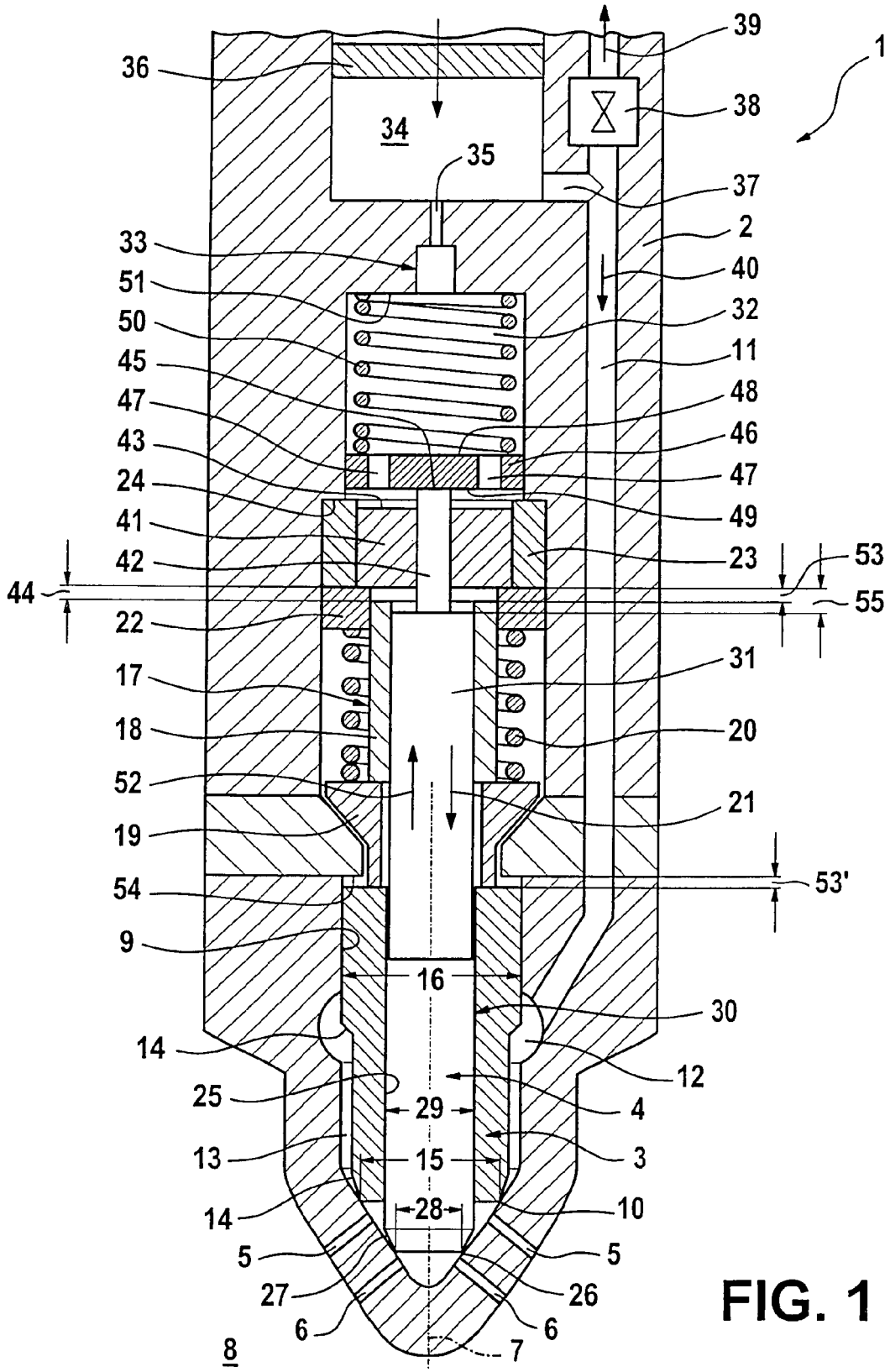
FIG. 1 is a very simplified schematic depiction of a longitudinal section through an injection nozzle according to the present invention.

According to FIG. 1, an injection nozzle 1 according to the present invention has a nozzle body 2 in which a first nozzle needle 3 and a second nozzle needle 4 are contained so that they can execute a stroke motion. The nozzle body 2 contains at least one first injection opening 5 and at least one second injection opening 6. Usually, several first injection openings 5 and/or several second injection openings 6 are provided, which are distributed symmetrically, in particular with reference to a longitudinal axis 7 of the nozzle body 2 or nozzle needles 3, 4, for example in a star pattern. Via the injection openings 5, 6, fuel can be injected or dispensed into an injection chamber 8, which can be constituted, for example, by a combustion chamber of a cylinder associated with the injection nozzle 1 or by a mixture-forming chamber leading to the respective cylinder.

A first needle guide 9 supports the first nozzle needle 3 so that it can execute a stroke motion in the nozzle body 2 and control the at least one first injection opening 5. To this end, the first nozzle needle 3 cooperates with a first sealing seat 10, which, in terms of a supply of fuel to the injection openings 5, 6, is situated upstream of the at least one first injection opening 5. The fuel supply includes a fuel supply line 11 that extends inside the nozzle body 2 and leads to a nozzle chamber 12. The nozzle chamber 12 extends via an annular chamber 13 to the injection openings 5, 6. In the nozzle chamber 12 and/or the annular chamber 13, the first nozzle needle 13 has at least one first pressure shoulder 14, which is designed so that a first seat cross-sectional area 15 of the first sealing seat 10 is smaller than a first guide cross-sectional area 16 of the first needle guide 9.

Furthermore, the first nozzle needle 3 here is a component of a first needle unit 17, which, as an example here, includes a coupling sleeve 18 and an intermediate element 19 situated between the coupling sleeve 18 and the first nozzle needle 3. The components of the first needle unit 17, i.e. in this case the first nozzle needle 3, the intermediate element 19, and the coupling sleeve 18, constitute a unit that can execute a shared stroke motion and is designed to transmit compressive forces. It is fundamentally possible for the individual components of the first needle unit 17 to be comprised of separate elements that merely rest against each other at their axial end surfaces without being directly fastened to one another. It is also fundamentally possible to fasten at least two of the individual components to each other or to combine them into an integrated component.

The first nozzle needle 3 or first needle unit 17 cooperates with a first closing spring 20 that prestresses the first nozzle needle 3 in a closing direction 21 symbolized by an arrow. In the embodiment form shown here, the first closing spring 20 rests against the intermediate element 19 at one end and at the other end, rests against a drive ring 22, which in turn rests by means of a stop sleeve 23 against the nozzle body 2, which for this purpose, has a correspondingly formed shoulder 24, protruding radially inward in this case, that acts as a stop. In an alternative design, the stop sleeve 23 can also be attached to the nozzle body 2 or formed onto it in an integral fashion.

In addition, the first nozzle needle 3 is embodied in the form of a hollow needle so that the second nozzle needle 4 can be situated coaxially inside the first nozzle needle 3. The second nozzle needle 4 is supported so that it can execute a stroke motion in a second needle guide 25 inside the first nozzle needle 3. The second nozzle needle 4 cooperates with a second sealing seat 26, which is situated, in terms of the fuel supply, downstream of the at least one first injection opening 5, but upstream of the at least one second injection opening 6. Correspondingly, the second nozzle needle 4 serves to control the at least one second injection opening 6. At its end oriented toward the injection openings 5, 6, the second nozzle needle 4 is provided with at least one second pressure shoulder 27 that is embodied so that a second seat cross-sectional area 28 of the second sealing seat 26 is smaller than a second guide cross-sectional area 29 of the second needle guide 25.

The second nozzle needle 4 is a component of a second needle unit 30, which, in addition to the first nozzle needle 3, includes at least one coupling rod 31. The coupling rod 31 extends inside the first nozzle needle 3 and inside the coupling sleeve 18. In addition, the intermediate element 19 is embodied in the form of an annular body with an opening in the center so that the coupling rod 31 can also extend coaxially through the intermediate element 19. The second needle unit 30, too, can be loaded with pressure and execute a stroke motion as a whole.

The injection nozzle 1 according to the present invention is also equipped with a control chamber 32 that communicates with a pressure chamber 34 via a throttle line 33. The throttle line 33 has a predetermined flow resistance, which can be suitably embodied in the form of a corresponding throttle 35. The pressure chamber 34 cooperates with a pressure generating device or fuel delivery unit, whose pressure generating action is schematically represented here in the form of a piston 36 that can execute a stroke motion. By means of the stroke motion of piston 36, the pressure in pressure chamber 34 can be controlled. However, in actual practice, the pressure generating device or fuel delivery unit might ultimately be, for example, a high-pressure fuel pump that supplies the injection nozzle 1 with the required high fuel pressure. The injection nozzle 1 shown here suitably constitutes a component of a so-called "unit injector". In an internal combustion engine that operates with a unit injector system for fuel injection, each cylinder is associated with its own unit injector.

The pressure chamber 34 communicates with the fuel supply line 11 via a connection 37; the connection 37 is attached to the fuel supply line 11 between the injection openings 5, 6 and a valve 38. The valve 38, in particular a solenoid valve, serves to open and close the fuel supply line 11. When the valve 38 is open, the fuel flows from the pressure chamber 34 through the connection 37 into the fuel supply line 11 and from there, in accordance with an arrow 39, away from the injection openings 5, 6, and for example into a reservoir suitably constituted by the fuel tank of the internal combustion engine. Since the reservoir is comparatively unpressurized, it is not possible for high pressure to build up in the fuel supply line 11. When the valve 38 is closed, the fuel cannot escape into the reservoir and therefore flows in accordance with an arrow 40 toward the injection openings 5, 6, thus simultaneously generating the required high pressure.

The injection nozzle 1 according to present invention is also equipped with a first control piston 41 and a second control piston 42. The first control piston 41 is embodied in the form of a hollow piston. The second control piston 42 is situated coaxially inside the first control piston 41.

The first control piston 41 cooperates with the first nozzle needle 3 or first needle unit 17.

To this end, in the starting position depicted here, which occurs when the first nozzle needle 3 is closed, the first control piston 41 rests against the drive ring 22 so that the drive ring 22 and the first closing spring 20 support it against the intermediate element 19 and consequently against the first needle unit 17. At an end oriented away from the injection openings 5, 6, the first control piston 41 also has a first control surface 43, which is situated in the control chamber 32 so that the control pressure prevailing in the control chamber 32 acts on the first control surface 43 of the first control piston 41 in the closing direction 21. Furthermore, the first control piston 41 is dimensioned and positioned so that in the initial position of the first control piston 41 depicted here, there is an axial play 44 between the first control piston 41 and the first nozzle needle 3 or first needle unit 17. In the embodiment form depicted here, the axial play 44 is embodied in the form of an axial distance between the axial ends of the first control piston 41 and the coupling sleeve 18 that are oriented toward each other.

By contrast, the second control piston 42 rests permanently against the second nozzle needle 4 or, as in this case, against the second needle unit 30, i.e. the second control piston 42 rests against the end of the coupling rod 31 oriented toward it. The second control piston 42 thus comprises a component of the second needle unit 30, whose components cooperate with one another to transmit pressure. It is also possible for at least two of the components of the second needle unit 30 to be attached to each other or for these components to comprise an integrally joined unit.

The second control piston 42 extends through the first control piston 41 and likewise protrudes into the control chamber 32. At an end oriented away from the injection openings 5, 6, the second control piston 42 has a second control surface 45 so that the control pressure prevailing in the control chamber 32 can also act on the second control surface 45 of the second control piston 42. The control pressure is not exerted directly on the control piston 42 but rather indirectly by means of a spring plate 46, which is supported so that it can execute a stroke motion in the control chamber 32. In the embodiment form depicted here, the spring plate 46 occupies the entire cross section of the control chamber 32 but has at least one pressure compensation opening 47 that connects the two separate axial sides 48 and 49 of the spring plate 46 so that they can communicate with each other, i.e. the at least one pressure compensation opening 47 allows a part of the control chamber 32 oriented toward the one axial side 48 to communicate with a part of the control chamber 32 oriented toward the other axial side 49. As a result, the same control pressure prevails in both parts of the control chamber 32 separated from each other by the spring plate 46. The pressure compensation openings 47 are dimensioned so that even with dynamic pressure changes in the control chamber 32, these pressure changes occur in the two parts of the control chamber 32 at essentially the same time. Consequently, on the two axial sides 48 and 49 of the spring plate 46, the same control pressure prevails as the one exerted on the second control surface 45 of the second control piston 42 in the control chamber 32 by means of the spring plate 46 since the second control surface 45 of the second control piston 42 rests against the spring plate 46. Alternatively, the at least one pressure compensation opening 47 can also be designed so that the opening and closing speed of the second needle unit 30 achieve a desired optimal speed.

The second nozzle needle 4 or second needle unit 30 is associated with a second closing spring 50, which, in the embodiment form depicted here, is situated in the control chamber 32 and rests against the spring plate 46 at one end and rests against the wall 51 of the nozzle body 2 at the other, which wall 51 axially delimits the control chamber 32 at an end oriented away from the injection openings 5, 6.

The injection nozzle 1 according to present invention functions as follows:

In the initial state depicted here, both of the nozzle needles 3, 4 are closed so that no fuel injection is taking place. The valve 38 is open so that a fuel volume possibly supplied into the pressure chamber 34 can escape into the reservoir in accordance with the arrow 39.

For certain operating states of the internal combustion engine, it can be necessary for a fuel injection to occur exclusively by means of the at least one first injection opening 5. In order to implement a fuel injection exclusively by means of the at least one first injection opening 5, the valve 38 is closed and as a result, the pressure in the pressure chamber 34 increases to a relatively low elevated injection pressure. The pressure increase in the pressure chamber 34 spreads via the fuel supply line 11 into the nozzle chamber 12 and into the annular chamber 13 so that it also acts against the at least one first pressure shoulder 14 of the first nozzle needle 3. The forces engaging the at least one first pressure shoulder 14 act in an opening direction 52 symbolized by an arrow and consequently counter to the closing force of the first closing spring 20. With a sufficient elevated injection pressure, the force equilibrium acting on the first nozzle needle 3 or first needle unit 17 reverses, yielding a resulting force acting in the opening direction 52. It is then possible for the first nozzle needle 3 to lift away from the first sealing seat 10. As a result, the at least one first injection opening 5 communicates with the annular chamber 13 so that fuel can be dispensed into the combustion chamber 8 through the at least one first injection opening 5.

As soon as the first nozzle needle 3 opens, it is possible for a pressure acting in the opening direction to build up against the at least one second pressure shoulder 27 of the second nozzle needle 4. With the relatively low elevated injection pressure that is set in this instance, though, the second nozzle needle 4 remains closed since the forces acting in the closing direction 21, i.e. the closing force of the second closing spring 50 and the force of the control pressure against the second control surface 45 still predominate.

With the relatively low elevated injection pressure, the delayed pressure buildup in the control chamber 32 has either no effect or hardly any effect on the opening behavior of the first nozzle needle 3. The control pressure prevailing in the control chamber 32 is consequently great enough to transmit sufficient closing forces to the second needle unit 30 by means of the second control piston 42 so that the second nozzle needle 4 remains closed. In addition, due to the axial play 44, the first nozzle needle 3 or first needle unit 17 is decoupled from the first control piston 41 as long as the closing force acting on the first control surface 43 is not greater than the closing force exerted by the first closing spring 20. In any case, as long as this condition exists, the first control piston 41 cannot move the drive ring 22 in the closing direction 21 when a pressure increase occurs in the control chamber 32.

The opening movement of the first nozzle needle 3 or first needle unit 17 can be limited by means of a first stroke stop 53, which is embodied by way of example here axially between the first control piston 41 and the coupling sleeve 18, i.e. at the end of its opening stroke, the first needle unit 17 comes into contact with the first control piston 41.

Alternatively, the first stroke stop 53' can also be embodied, for example, between the first nozzle needle 3 and a corresponding shoulder 54 of the nozzle body 2. In this embodiment form, then, in the closed position of the first nozzle needle 3, the axial play 44 is greater than an axial distance between the above-mentioned shoulder 54 of the nozzle body 2 and the axial end surface of the first nozzle needle 3 that cooperates with it.

In order to close the first nozzle needle 3, the valve 38 is opened so that the relatively low elevated injection pressure in the fuel supply line 11 is completely discharged. Consequently, the closing forces in the first nozzle needle unit 17 predominate once again, driving the needle unit 17 in the closing direction 21. As soon as the first nozzle needle 3 has moved into its first seat 10, the injection process is terminated. The delayed pressure decrease in the control chamber 32 here does not assist the closing motion of the first needle unit 17 since the closing force of the first closing spring 20 is sufficient to hold the first control piston 41 in its initial position.

In other operating states of the internal combustion engine, it can be necessary to dispense more fuel at a mid-level elevated injection pressure exclusively by means of the at least one first injection opening 5. To this end, the valve 38 is closed and high pressure is slowly built up in the pressure chamber 34. The mid-level elevated injection pressure then builds up in the fuel supply line 11, which initially causes the first nozzle needle 3 to open. The slow pressure buildup in the pressure chamber 34 causes the pressure in the control chamber 32 to build up, delayed only slightly by the throttle 35.

By means of the first control surface 43 and the coupling sleeve 18, a closing needle force less intense than the opening needle force builds up on the first nozzle needle 3. By means of the second control surface 45, the second needle unit 30 is subjected to a closing needle force, which, together with the prestressing spring force acting in the closing direction exerted by the closing spring 50, is greater than the forces acting on the second needle unit 30 in the opening direction. As a result, the second nozzle needle 4 does not open.

In order to close the first nozzle needle 3, the valve 38 is opened so that the relatively mid-level elevated injection pressure in the fuel supply line 11 is completely discharged. Consequently, the closing forces in the first needle unit 17 once again predominate, driving the needle unit 17 in the closing direction 21. As soon as the first nozzle needle 3 has moved into its first seat 10, the injection process is terminated. The delayed pressure decrease in the control chamber 32 here assists the closing motion of the first needle unit 17. By means of the first control surface 43, the control pressure generates a closing needle force on the first needle unit 17, which presses the first nozzle needle 3 against the first sealing seat 10. As the control pressure falls further, the first closing spring 20 holds the first nozzle needle 3 against the first sealing seat 10 and the first control piston 41 moves into its initial position.

In other operating states of the internal combustion engine, it can be necessary to dispense more fuel at a middle to high elevated injection pressure through both the at least one first injection opening 5 and the at least one second injection opening 6. To this end, the valve 38 is closed and a middle to high elevated pressure is built up in the pressure chamber 34 at a relatively middle to high speed. The elevated injection pressure then builds up in the fuel supply line 11, which initially causes the first nozzle needle 3 to open. Then the elevated injection pressure also builds up against the at least one second pressure shoulder 27 of the second nozzle needle 4. The mid-speed to high speed pressure buildup causes the pressure in the control chamber 32 to build up, but only in a delayed fashion due to the presence of the throttle 35, and only a delayed buildup of closing forces occurs via the control surfaces 43 and 45 of the control pistons 41 and 42. The opening forces thus generated overcome the closing forces acting on the second needle unit 30. Consequently, the second nozzle needle 4 can also open.

The opening stroke of the second nozzle needle 4 is limited by a second stroke stop 55, which in this instance is embodied between the coupling rod 31 and the first control piston 41, i.e. with a sufficient opening stroke, an axial end surface of the coupling rod 31 of the second needle unit 30 comes into contact with the axial end surface of the first control piston 41 oriented toward it.

Figure 2:
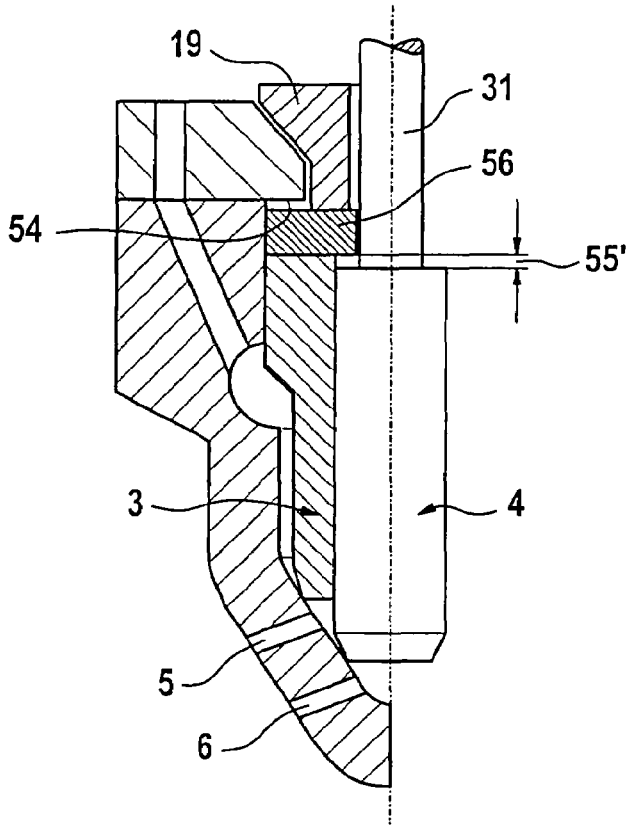
FIGS. 2 and 3 show schematic detail views of the injection nozzle, but in different embodiment forms.
Figure 3:
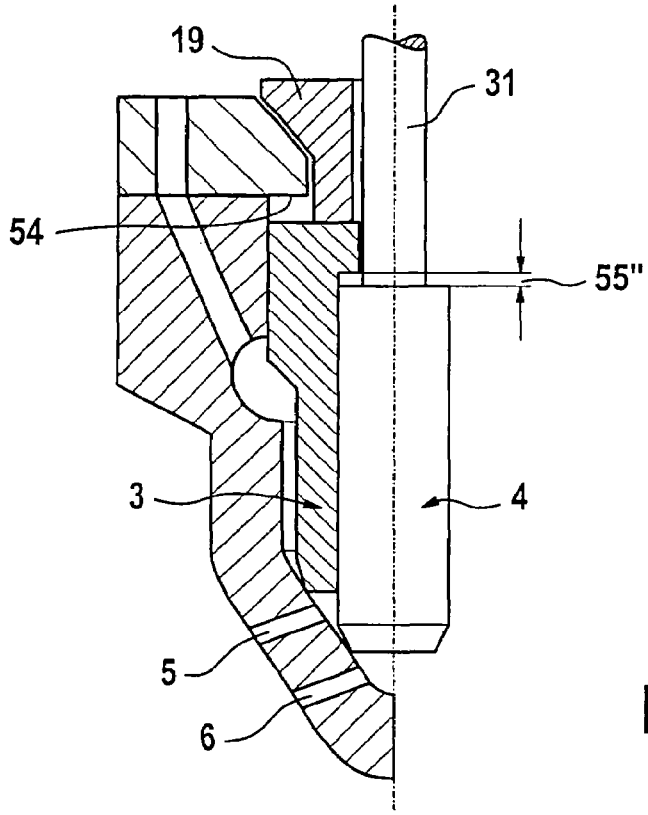

Alternatively, the second stroke stop 55' according to FIG. 2 can also be embodied on a washer 56. The second stroke stop 55" according to FIG. 3 can also be embodied directly on the first nozzle needle 3.

It is important here that with the buildup of elevated injection pressure at both the relatively slow speed and middle speed, the time delay with which the respective elevated injection pressure also builds up in the control chamber 32 via the throttle line 33 is still relatively slight so that only comparatively slight pressure differences arise between the pressure chamber 34 and the control chamber 32. Consequently, the second nozzle needle 4 reacts comparatively slowly to the increasing pressure against the at least one second pressure shoulder 27 and opens comparatively late.

There is thus a small to mid-sized pressure difference between the control chamber 32 and the pressure chamber 34 so that in order to open the second nozzle needle 4, it is necessary to overcome not only the closing force of the second closing spring 50, but also an increased closing force engaging the second control surface 45 due to the increased control pressure in the control chamber 32. At low and mid-level elevated injection pressures, the increasing control pressure in the control chamber 32 consequently counteracts an abrupt opening motion of the second nozzle needle 4.

To terminate the injection process, the valve 38 is opened again so that the mid-level elevated injection pressure in the fuel supply line 11 is completely discharged. Consequently, the forces acting on both the first needle unit 17 and the second needle unit 30 in the closing direction 21 predominate, as a result of which both of the nozzle needles 3 and 4 close. The delayed pressure decrease in the control chamber 32 assists the closing motion of the two nozzle needles 3, 4.

In other operating states of the internal combustion engine, it can be necessary to rapidly dispense a large amount of fuel at a relatively high injection pressure into the combustion chamber 8 through both the at least one first injection opening 5 and the at least one second injection opening 6. For example, this is when the internal combustion engine is running at comparatively high speeds so that in connection with the relatively high injection pressure, it is desirable to achieve both extremely short opening times and extremely short closing times for the two needles 3 and 4.

Here, too, in order to open the nozzle needles 3, 4, the valve 38 is closed and the desired, relatively high elevated injection pressure is generated in the pressure chamber 34. This high elevated injection pressure spreads through the fuel supply line 11 to the at least one first pressure shoulder 14 of the first nozzle needle 3. Since the first nozzle needle 3 is designed so that it opens at a relatively low elevated injection pressure, it reacts immediately and opens very early. After the first nozzle needle 3 opens, the pressure also increases against the at least one second pressure shoulder 27 of the second nozzle needle 4. As a result, the fuel pressure against the at least one second pressure shoulder 27 of the second nozzle needle 4 increases significantly faster than the pressure in the control chamber 32, which is connected to the pressure chamber 34 via the throttle line 33. This generates a relatively large pressure difference between the pressure chamber 34 and the control chamber 32 in which the throttle connection plays a particularly significant role. The forces acting on the second needle unit 30 in the closing direction 21 are essentially limited to the closing force of the second closing spring 50 and the compression force exerted on the second control surface 35 by control pressure in the control chamber 32, which is still low. Consequently, the high fuel pressure building up against the second pressure shoulder 27 can very quickly overcome the closing forces of the second needle unit 30 so that the second needle 4 also reacts very quickly and opens.

With a sufficiently long opening time, the high injection pressure of the pressure chamber 34 also spreads into the control chamber 32 in a delayed fashion via the throttle line 33.

If the injection process is then to be terminated, the valve 38 is opened and the high injection pressure in the pressure chamber 34 falls. This pressure drop then spreads immediately to the pressure shoulders 14 and 27 of the nozzle needles 3 and 4, thus reducing the forces acting in the opening direction on the needle units 17 and 30. At the same time, the throttle 35 generates a comparatively large pressure difference between the control chamber 32 and the pressure chamber 34 so that now, the control pressure of the control chamber 32, which is still relatively high, engages both the first control surface 43 and the second control surface 45, consequently imparting powerful closing forces to the first control piston 41 and the second control piston 45.

This causes the first control piston 41 to move in the closing direction 21. If the first control piston 41 constitutes the second stroke stop 55 for the second nozzle needle 4 as it does in this instance, then it carries the second needle unit 30 along with it. In other instances, it is carried along by the alternative second stroke stop 55' or 55". Moreover, the first control piston 41 can simultaneously constitute the first stroke stop 53 for the first nozzle needle 3 so that during its closing motion, the control piston 41 also carries the first needle unit 17 along with it. As long as an axial play remains between the first control piston 41 and the coupling sleeve 18, the first control piston 41 initially executes a relatively small idle stroke in relation to the first needle unit 17 and only then does it carry the first needle unit 17 along with it. The high pressure in the control chamber 32 can thus abruptly push the two nozzle needles 3, 4 or two needle units 17, 30 in the closing direction 21 by means of the control pistons 41, 42, which results in the achievement of very short closing times for the two nozzle needles 3, 4. The control pressure in the control chamber 32 is discharged by means of the stroke motion of the control pistons 41, 42 and by means of the throttle 35.

The sudden or abrupt acceleration due to the high control pressure acting mainly on the first control surface 43 and also on the second control surface 45 overcomes the inertial forces in order to accelerate the needle units 17, 30, thus permitting the achievement of extremely short closing times, even if the control pressure in the control chamber 32 decreases due to the axial movement of the first control piston 41. It is also important that the extremely short closing times become shorter the higher the respective elevated injection pressure is selected to be. In mid-sized and small changes in the elevated injection pressure, the delay effect due to the throttle line 33 has either no effect or only an insignificant effect on the increase or decrease of the control pressure in the control chamber 32, which is also desirable for the respective operating states of the internal combustion engine. In the injection nozzle 1 according to the present invention, it is particularly advantageous that both nozzle needles 3, 4 are controlled by means of the injection pressure so that no servo control is required. It is consequently comparatively inexpensive to produce the injection nozzle 1 according to the present invention.

During the closing of the nozzle needles 3 and 4, in addition to the two needle units 17, 30, the first control piston 41 also carries the drive ring 22 along with it, simultaneously placing the first closing spring 20 under stress. This increases the closing force of the first closing spring 20 so that as the closing force of the first control piston 41 slackens, an increased closing force still continues to act on the first needle unit 17 in order to close the first nozzle needle 3 as fast as possible. A rapid closing of the first nozzle needle 3 is of primary importance for a rapid termination of the injection process. This is so because as soon as the first nozzle needle 3 is closed, the at least one second injection opening 6 is also disconnected from the fuel supply, thus terminating the introduction of fuel through the at least one second injection opening 6, even if the second nozzle needle 4 has not yet traveled into the second sealing seat 26.

As soon as the throttle line 33 has caused the control pressure to decrease sufficiently, the first closing spring 20, acting via the drive ring 22, can push the first control piston 41 back into its initial position according to FIG. 1. The end of the return motion is reached when the drive ring 22 comes into contact with the stop sleeve 23 and this comes into contact with the shoulder 24.

The foregoing relates to preferred exemplary embodiments of the invention, it being understood that other variants and embodiments thereof are possible within the spirit and scope of the invention, the latter being defined by the appended claims.

The invention claimed is:

1. An injection nozzle for an internal combustion engine, in particular in a motor vehicle, the nozzle comprising, a first nozzle needle, which is embodied in the form of a hollow needle and is able to control an injection of fuel through at least one first injection opening, a second nozzle needle, which is situated coaxial to the first nozzle needle and is able to control the injection of fuel through the at least one second injection opening, a control chamber, a first control piston and a second control piston, wherein the second control piston axially cooperates with the second nozzle needle or a second needle unit that includes the second nozzle needle, an end surface of the second control piston oriented away from the injection openings being situated in the control chamber, thus permitting it to be acted on with the control pressure prevailing therein, the second control piston resting axially against the second nozzle needle or second needle unit in a closed position of the second nozzle needle the first control piston being embodied in the form of a hollow piston and cooperating axially with the first nozzle needle or a first needle unit containing the first nozzle needle, the second control piston is situated coaxial to the first control piston, a first control surface of the first control piston oriented away from the injection openings situated in the control chamber, thus permitting the control surface to be acted on with the control pressure prevailing therein, an axial play between the first control piston and the first nozzle needle or first needle unit, in a closed position of the first nozzle needle a throttle line providing communication between the control chamber and a pressure chamber, and means for adjusting the pressure in the pressure chamber.

2. The injection nozzle according to claim 1, further comprising a first closing spring, which on the one hand, drives the first nozzle needle or first needle unit in the closing direction and on the other hand, directly or indirectly drives the first control piston into an initial position in which the axial play is present between the first control piston and the first nozzle needle or first needle unit.

3. The injection nozzle according to claim 2, wherein the first closing spring rests against the first control piston by means of a drive ring, and the drive ring comes into axial contact with a stop when it reaches the initial position of the first control piston.

4. The injection nozzle according to claim 3, wherein the stop is embodied on a stop sleeve situated coaxial to the first control piston and resting axially against a nozzle body of the injection nozzle.

5. The injection nozzle according to claim 1, wherein the first control piston constitutes a first stroke stop for the first nozzle needle or first needle unit so that in an open position of the first nozzle needle, the first control piston comes into direct axial contact with the first nozzle needle or first needle unit.

6. The injection nozzle according to claim 2, wherein the first control piston constitutes a first stroke stop for the first nozzle needle or first needle unit so that in an open position of the first nozzle needle, the first control piston comes into direct axial contact with the first nozzle needle or first needle unit.

7. The injection nozzle according to claim 1, wherein the first control piston has a second stroke stop for the second nozzle needle or second needle unit so that in an open position of the second nozzle needle, the first control piston comes into direct axial contact with the second nozzle needle or second needle unit.

8. The injection nozzle according to claim 2, wherein the first control piston has a second stroke stop for the second nozzle needle or second needle unit so that in an open position of the second nozzle needle, the first control piston comes into direct axial contact with the second nozzle needle or second needle unit.

9. The injection nozzle according to claim 3, wherein the first control piston has a second stroke stop for the second nozzle needle or second needle unit so that in an open position of the second nozzle needle, the first control piston comes into direct axial contact with the second nozzle needle or second needle unit.

10. The injection nozzle according to claim 4, wherein the first control piston has a second stroke stop for the second nozzle needle or second needle unit so that in an open position of the second nozzle needle, the first control piston comes into direct axial contact with the second nozzle needle or second needle unit.

11. The injection nozzle according to claim 5, wherein the first control piston has a second stroke stop for the second nozzle needle or second needle unit so that in an open position of the second nozzle needle, the first control piston comes into direct axial contact with the second nozzle needle or second needle unit.

12. The injection nozzle according to claim 1, further comprising a second stroke stop for the second nozzle needle embodied directly on the first nozzle needle or on a washer of the first needle unit.

13. The injection nozzle according to claim 2, further comprising a second stroke stop for the second nozzle needle embodied directly on the first nozzle needle or on a washer of the first needle unit.

14. The injection nozzle according to claim 3, further comprising a second stroke stop for the second nozzle needle embodied directly on the first nozzle needle or on a washer of the first needle unit.

15. The injection nozzle according to claim 4, further comprising a second stroke stop for the second nozzle needle embodied directly on the first nozzle needle or on a washer of the first needle unit.

16. The injection nozzle according to claim 5, further comprising a second stroke stop for the second nozzle needle embodied directly on the first nozzle needle or on a washer of the first needle unit.

17. The injection nozzle according to claim 1, further comprising a second closing spring axially resting directly or indirectly against the second control piston and, by means of the second control piston, driving the second nozzle needle or second needle unit in the closing direction.

18. The injection nozzle according to claim 17, wherein the second closing spring is situated in the control chamber.

19. The injection nozzle according to claim 7, wherein that the second closing spring rests against a spring plate that rests axially against the second control piston, is able to move in the control chamber in the axial direction, and enables a pressure compensation between its two axial sides oriented away from each other.

20. The injection nozzle according to claim 19, wherein the spring plate is supported in the control chamber in an axially movable fashion and has at least one pressure compensation opening that connects the axial sides of the spring plate so that they are able to communicate with each other.

* * * * *